United States Patent [19]

Hayasaki

[11] Patent Number: 4,776,467

[45] Date of Patent: Oct. 11, 1988

[54] SORTING APPARATUS FOR SORTING ARTICLES

[75] Inventor: Nobuyoshi Hayasaki, Kawasaki, Japan

[73] Assignee: Kabushiki Kaisha Toshiba, Kawasaki, Japan

[21] Appl. No.: 926,171

[22] Filed: Nov. 3, 1986

[51] Int. Cl.[4] ..... B07C 5/06; B07C 1/14

[52] U.S. Cl. ..... 209/620; 209/658; 209/900

[58] Field of Search ..... 209/651, 654, 658, 620, 209/900, 659; 198/447, 436, 440

[56] References Cited

U.S. PATENT DOCUMENTS

| | | | |
|---|---|---|---|
| 888,408 | 5/1908 | Strain | 209/651 |
| 3,004,663 | 10/1961 | Creoglio | 209/654 |
| 3,059,770 | 10/1962 | Fichtmuller | 209/651 |
| 3,513,972 | 5/1970 | Sakurai et al. | 209/651 |

FOREIGN PATENT DOCUMENTS

| | | | |
|---|---|---|---|
| 1383914 | 11/1964 | France | 209/900 |
| 1925647 | 5/1962 | Fed. Rep. of Germany . | |
| 5876169 | 10/1981 | Japan . | |
| 1035783 | of 1906 | United Kingdom | 209/900 |

*Primary Examiner*—Robert B. Reeves
*Assistant Examiner*—Donald T. Hajec
*Attorney, Agent, or Firm*—Cushman, Darby & Cushman

[57] ABSTRACT

An apparatus for sorting articles each having a predetermined thickness comprises conveying belt for carrying and conveying the articles in one direction and a first sorter provided through an interval substantially equal to a predetermined thickness of the article above a conveying belt for conveying the article conveyed in contact toward one side end of the belt to exclude from one side end of the belt and a second sorter provided through an interval substantially equal to a predetermined thickness of the article above the belt for conveying the article conveyed in contact toward the other side end of the belt to exclude from the other side end of the conveying surface of the belt. A pair of reconveying belts are provided under the both side ends of the conveying belt for reconveying the excluded article and a pair of resorters are provided above the reconveying belts for excluding an article having a predetermined thickness or larger of the articles conveyed by the reconveying belts.

9 Claims, 4 Drawing Sheets

SORTING APPARATUS FOR SORTING ARTICLES

BACKGROUND OF THE INVENTION

The present invention relates to a sorting apparatus for sorting articles in response to the thickness (or height) of the article.

Conventional sorting apparatuses for sorting articles in response to the thickness (or height) of the article have heretofore been variously developed and employed in a practical use such as, for example, as disclosed in Japanese Patent Application Laid-open No. 76169/1983. This sorting apparatus has a predetermined interval from the upper surface of a conveying passage, feeds a belt with pawls in the lateral direction of the passage and sorts sheets to exclude the sheets each having a thickness larger than the interval from the passage. This apparatus can remove sheets each having a predetermined thickness (or height) or larger. However, when a large quantity of sheets are simultaneously supplied from one side end of the conveying passage in this apparatus, it is disadvantageous that the sheets of lumped state each having a predetermined thickness to increase the entire thickness due to the lumped state are excluded by a thickness sorter.

SUMMARY OF THE INVENTION

It is an object of the present invention to provide a sorting apparatus for reliably sorting articles even if a large quantity of articles are simultaneously supplied to a conveying passage.

BRIEF DESCRIPTION OF THE DRAWINGS

FIGS. 1 to 6 are views for illustrating one embodiment of the invention, wherein FIG. 1 is a sectional view of an apparatus for sorting letters, FIG. 2 is a perspective view of a first sorter and a second sorter in the apparatus, FIG. 3 is a side view showing a sorter and a conveying passage provided with a gap therebetween, FIG. 4 is a perspective view showing first resorting means and second resorting means in the apparatus, FIG. 5 is a view for describing the stream of articles in the apparatus in FIG. 2, and FIG. 6 is a view for describing the stream of articles in the apparatus in FIG. 4.

DETAILED DESCRIPTION OF THE PREFERRED EMBODIMENTS

An embodiment of the present invention applied to a sorting apparatus for sorting letters according to thickness will be described in detail with reference to FIGS. 1 to 6.

Figure 1:
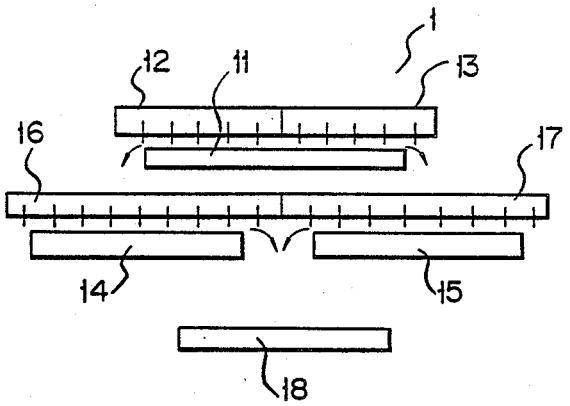

FIG. 1 is a sectional view showing an apparatus for sorting letters according to thickness. The apparatus largely comprises conveying passage 11 for carrying and conveying letters or articles, first and second thickness sorters 12 and 13 for sorting to exclude the article provided on the passage and having a larger thickness than a predetermined thickness, first and second reconveying passages 14 and 15 for carrying and conveying the articles sorted (excluded) by first and second sorters 12 and 13, respectively, first and second resorters 16 and 17 provided on first and second passages 14 and 15, respectively for sorting (excluding) the articles having a larger thickness and rejecting one onto conveying passage 18 for conveying the article sorted (excluded) by first and second sorters 16 and 17.

Figure 2:
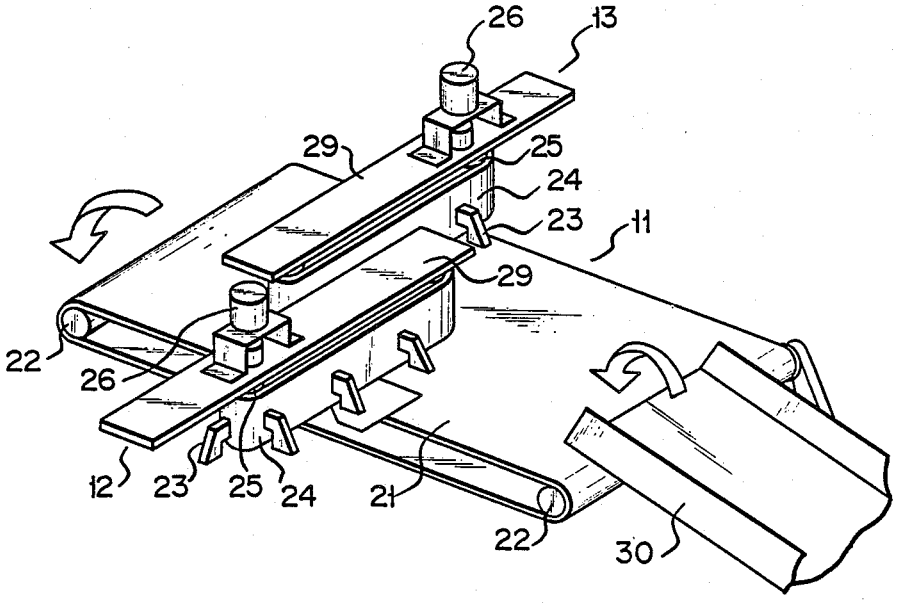
Figure 3:
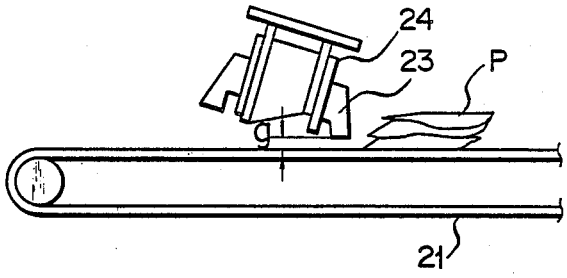

Passage 11, first and second sorters 12 and 13 are constructed as shown in FIG. 2. Passage 11 has endless conveying belt 21 extending substantially horizontally, a pair of rollers 22 for rotatably feeding belt 21, and a drive motor coupled with one of rollers 22 for driving the roller. Sorters 12 and 13 are provided laterally with respect to a conveying direction, and each has endless belt 24 integrally formed with a plurality of pawls 23 at a predetermined interval on the surface thereof and made of synthetic resin or rubber, a pair of rollers 25 supported by a supporting plate 29 and rotatably supporting belt 24, and a drive motor 26 provided on plate 29 and coupled with one of rollers 25 for driving the roller. Plate 29 is fixed by supporting means, not shown, extending at a predetermined interval on the upper surface of belt 21 substantially in parallel (preferably slightly obliquely as shown in FIG. 3) with the lateral direction of belt 21. A pair of rollers 25 are rotatably supported to plate 29, mounted on a rotational shaft extending downwardly and disposed at one roller outside from one side end of belt 21 and at the other at the other side end side from the center of belt 21. Thus, pair of belts 24 supported on the rollers are overlapped at one ends at the center of belts 21 and disposed at the other outwardly from the side ends of belts 21, with the result that belts 24 are extended over the entire width of belt 21. Pawls 23 are formed, as shown in FIG. 3, of an L-shaped portion made of a part substantially horizontally extended from belt 24 and a part disposed at the end extended downwardly from the end lower than belt 24, and disposed at the end, i.e., the lower end of the pawl above the upper surface or conveying surface of belt 21 at a predetermined gap g. Pair of belts 24 are driven by the motor in opposite direction to one another to move pawls 23 provided thereat toward the side end direction of belt 21 and to exclude letters engaged with pawls 23 from the side end of the belt.

A supplying device 30 for supplying letters to passage 11 is provided at the front end side of the conveying direction of passage 11. This device is constructed, for example, similar to a hopper disclosed, for example, in Japanese Patent Application Laid-open No. 76169/83 official gazette and formed of an endless belt disposed at one end above belt 21. The supplying end of device 30 is disposed substantially at the center laterally of belt 21 to supply letters dispersively in the lateral direction of the conveying passage.

Figure 4:
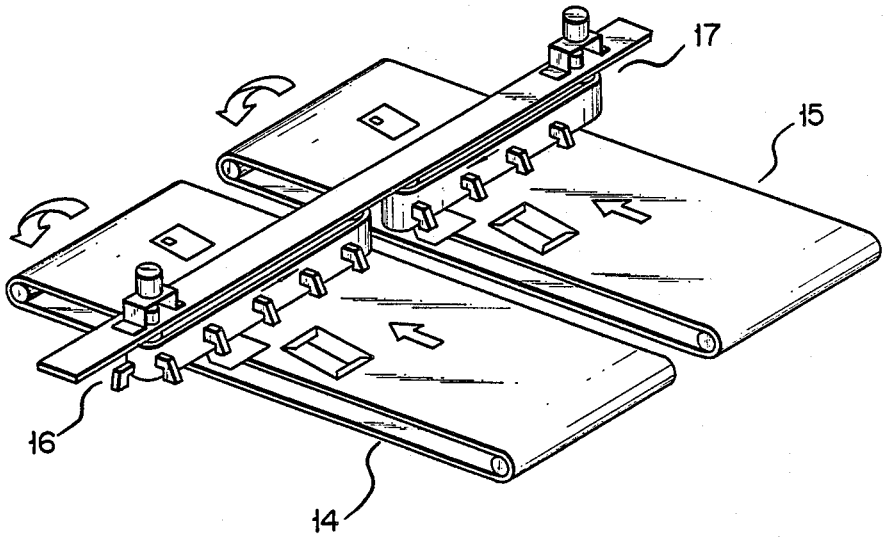

As shown in FIG. 4, first and second reconveying passages 14 and 15 made, as shown in FIG. 1, of endless belts are provided in parallel with each other, as shown in FIG. 4, below both side ends of passage 11. Passage 14 carries and feeds the article sorted (excluded) by first sorter 12, and passage 15 carriers and feeds the article sorted (excluded) by second sorter 13. First and second resorters 16 and 17 having constructions similar to those of sorters 12 and 13 are provided on passages 14 and 15, respectively. Resorters 16 and 17 are fed toward a gap between the first and second passages 14 and 15 as designated by arrows in FIG. 4 to sort (exclude) the article having a predetermined thickness or larger between passages 14 and 15. A rejecting conveying passage 18 made of an endless belt is provided under a gap between passages 14 and 15 to convey letters sorted (excluded) to guide to a predetermined collector.

Figure 5:
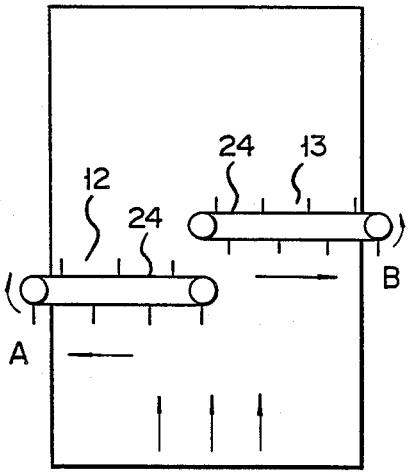

The operation of the apparatus constructed as described above will be described. A large quantity of letters P supplied onto passage 11 are conveyed by belt 21. In this case, letters P of laminated state are collided with the surfaces of belts 24 of first and second sorters 12 and 13, overturned, and separated while colliding with belts 24 upon feeding of belt 21. Therefore, as shown in FIG. 5, the letters collided with belt 24 of first sorter 12 are sorted while conveying to the left side (in the direction of an arrow A in FIG. 5) of passage 11, and the letters collided with belt 24 of second sorter 13 are sorted while conveying to the right side (in the direction of an arrow B in FIG. 5) of passage 11. When the thickness of letter P separated into indlvidual letter is less than a gap g, the letter passes first and second sorters 12 and 13 to be conveyed to the conveying end side.

Figure 6:
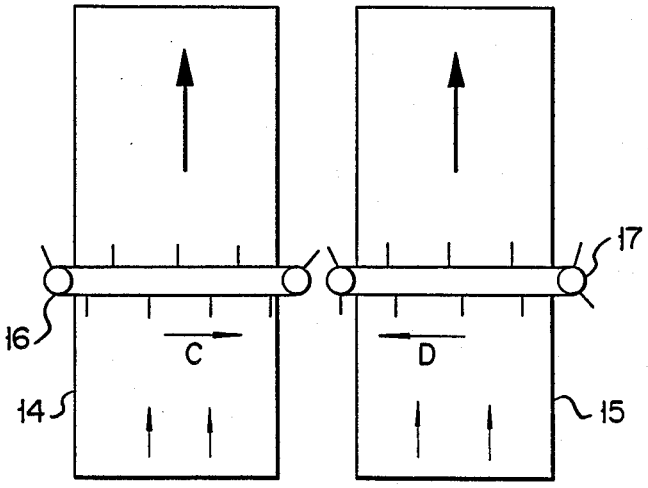

The letters sorted (excluded) by sorters 12, 13 are dropped on first and second passages 14, 15 to be conveyed. The letter having a larger thickness than a predetermined one is conveyed, as shown in FIG. 6, by first and second resorters 16 and 17 in the directions of arrows C and D toward a gap between the passages, and dropped on passage 18. The letter supplied on passage 18 is guided to a collector, not shown. The letters separated to individual letters each having a thickness smaller than a gap g are passed through the sorters and conveyed to the end side of the passage in first and second sorting means 16 and 17.

According to the embodiment described above, the letters supplied by the supplying device are divied reversely by first and second sorters 12 and 13, separated from lumped state at supplying time, and sorted. Further, the excluded letters are again sorted by first and second resorters. Therefore, the letters can be sorted with less error Further, in the embodiment described above, the first and second resorters exclude the letters toward a gap between the conveying passages. Accordingly, the excluded letters can be conveyed on the same conveying passage (rejecting conveying passage), thereby reducing the size of the appaatus.

Figure 7:
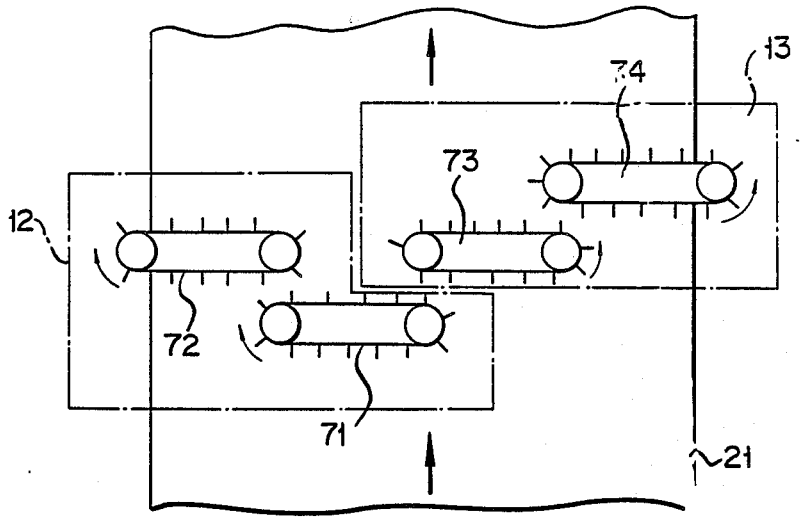
FIGS. 7 and 8 are views for respectively describing other embodiments of the present invention.

In the embodiment described above, the first and second sorting means are respectively composed of individual sorting mechanisms. However, as shown in FIG. 7, the individual sorting means may be composed of a plurality (two in this embodiment) of sorting mechanisms. In this embodiment, first sorting means 12 is composed of first sorting mechanism 71 and second sorting mechanism 72, second sorting means 13 is composed of third sorting mechanism 73 and fourth sorting mechanism 74, and the sorting mechanisms are all driven in a direction as designated by arrows. The sorting mechanisms have the same constructions as the sorters described with respect to the aforementioned embodiment, and the description thereof will be omitted. First and second sorting mechanisms 71 and 72 are overlapped at the ends to extend substantially from the center of lateral direction of belt 21 outwardly of one side end. Third and fourth sorting mechanisms 73 and 74 are overlapped at the ends, one end of third mechanism 73 is overlapped with one end of first mechanism 71, and the other end of fourth mechanism 74 is extended outwardly of the other end of belt 21.

In the apparatus shown in FIG. 7, the letters conveyed by belt 21 and sorted by first and third mechanisms 71 and 73 are again sorted by second and fourth mechanism 72 and 74.

Figure 8:
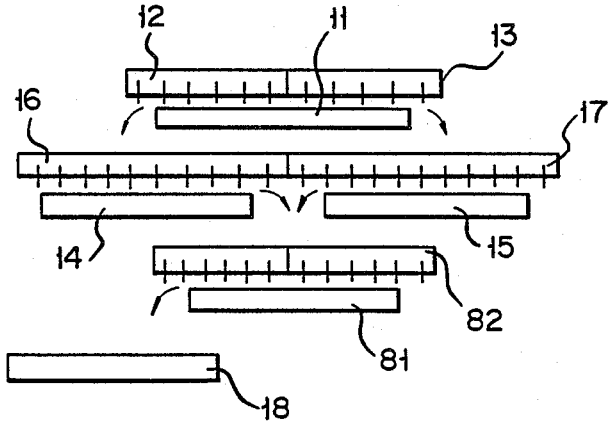

In the embodiment described above, to prevent the letters from being erroneously sorting, another sorter 82 may be further provided on third conveying passage 81 for conveying the articles (letters) sorted by first and second resorter 16 and 17 as shown in FIG. 8 to convey the articles sorted by the sorters on rejecting conveying passage 18.

What is claimed is:

1. An apparatus for sorting articles each having a predetermined thickness comprising:

conveying means having a conveying surface of predetermined width with longitudinal side edges extending in a conveying direction for carrying and conveying the articles thereon in the conveying direction;

first and second thickness sorting means mounted above said conveying means so as to be spaced a predetermined distance from the conveying surface of said conveying means, said first and second sorting means each being mounted so as to extend across at least a portion of the width of said conveying means so that one end of said first sorting means overlaps at least a portion of one end of said second sorting means, said first and second sorting means each including means for removing articles having a thickness greater than said predetermined distance from the conveying surface of said conveying means;

reconveying means mounted under the side edge of said conveying means and having a reconveying surface for reconveying the removed articles; and resorting means mounted a predetermined distance from the reconveying surface of said reconveying means for removing articles having a thickness greater than said predetermined distance.

2. The apparatus according to claim 1, wherein said first and second sorting means include respectively first and second sorting mechanisms which each extend laterally with respect to said conveying means and extend from at least said longitudinal side edges thereof to a point respectively beyond a center line thereof so as to overlap a longitudinal end of the other of said first and second sorting mechanism.

3. The apparatus according to claim 1, wherein said conveying means includes first and second reconveying passages disposed under the side edges of the said reconveying means, said first and second reconveying passages extending in parallel and being spaced a predetermined distance from each other and each defining longitudinal side edges, and wherein said resorting means includes first and second resorting mechanisms mounted respectively above said first and second reconveying passages for urging articles coming into to contact therewith toward the side edges of said first and second reconveying passages so as to remove said articles from the reconveying surfaces thereof.

4. The apparatus according to claim 3, further comprising a third reconveying passage disposed under the side edges of said first and second reconveying passages for conveying the articles excluded from said first and second reconveying passages.

5. The apparatus according to claim 4, wherein said first and second sorting means respectively include first and second sorting mechanisms which extend toward the side edges of said conveying means for conveying the articles coming into contact therewith toward the side edges of said conveying means.

6. The apparatus according to claim 5, wherein said first and second sorting mechanisms extend in a direction perpendicular to the conveying direction of said conveying means and have longitudinal ends disposed outwardly beyond the side edges of said conveying means.

7. The apparatus according to claim 4, further comprising a third resorting mechanism mounted so as to be spaced a predetermined at distance from said third reconveying passage for excluding an article having a larger thickness than said predetermined distance and a conveying passage for conveying the articles excluded by said third resorting mechanism.

8. An apparatus for sorting articles having a predetermined thickness comprising:

a conveying belt having a conveying surface of predetermined width with longitudinal side edges extending in a conveying direction for carrying and conveying the articles in the conveying direction;

first sorting means having a sorter mounted a predetermined distance above the conveying surface of said belt which distance is substantially equal to a predetermined article thickness for conveying articles having a thickness greater than said predetermined article thickness toward one side edge of said belt so as to remove said articles having a greater thickness from the conveying surface of said belt;

second sorting means including a sorter mounted a predetermined distance above the conveying surface of said belt which distance is substantially equal to a predetermined article thickness for conveying articles having a thickness greater than said predetermined article thickness toward the other side edge of said belt so as to remove said articles from the conveying surface of said belt, the sorters of said first and second sorting means being mounted so that one end of the sorter of said first sorting means overlaps at a least a portion one end of the sorter of said second sorting means;

reconveying means mounted under the side edges of said conveying means having a reconveying surface for reconveying the removed articles; and resorting means mounted a predetermined distance above said reconveying means for removing articles having a thickness greater than or equal to said predetermined distance from said reconveying means.

9. The apparatus according to claim 8, wherein said first and second sorting means each extend across the width of said belt from said respective side edges so as to overlap at the center of said belt.

* * * * *